US005925194A

United States Patent [19]

Wilson et al.

[11] Patent Number: 5,925,194

[45] **Date of Patent: *Jul. 20, 1999**

[54] DE-OILING METHOD

[75] Inventors: John Glencross Wilson, Wishaw; John Corstorphine, Newton Mearns, both of United Kingdom

[73] Assignee: Consarc Engineering Limited, Strathclyde, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/663,232

[22] PCT Filed: Dec. 19, 1994

[86] PCT No.: PCT/GB94/02760

§ 371 Date: Jun. 17, 1996

§ 102(e) Date: Jun. 17, 1996

[87] PCT Pub. No.: WO95/16807

PCT Pub. Date: Jun. 22, 1995

[30] Foreign Application Priority Data

Dec. 18, 1993 [GB] United Kingdom ..... 9325925

[51] Int. Cl.[6] ..... B08B 7/00

[52] U.S. Cl. ..... 134/19; 134/21; 134/39; 134/40

[58] Field of Search ..... 134/19, 21, 39, 134/40

[56] References Cited

U.S. PATENT DOCUMENTS

| | | | |
|---|---|---|---|
| 4,141,373 | 2/1979 | Kartanson et al. | 134/21 |
| 4,329,201 | 5/1982 | Bolton | 162/198 |
| 5,614,029 | 3/1997 | Nakatsukasa et al. | 134/5 |

FOREIGN PATENT DOCUMENTS

| | | |
|---|---|---|
| 0 530 405 A1 | 3/1993 | European Pat. Off. . |
| 0 541 892 A3 | 5/1993 | European Pat. Off. . |
| 0 554 026 A1 | 8/1993 | European Pat. Off. . |
| 1438174 | 6/1976 | United Kingdom . |

OTHER PUBLICATIONS

*Vacuum Deoiling for Environmentally Safe Parts Cleaning*, by W. Mitten, pp. 29–31, Metal Finishing; vol. 89, No. 9; Sep. 1991.

*Primary Examiner*—Scott W. Houtteman
*Attorney, Agent, or Firm*—Pennie & Edmonds LLP

[57] ABSTRACT

An apparatus for use in de-oiling components comprises a furnace (10) for receiving components to be de-oiled and pumps (12, 14, 16) for creating a vacuum in the furnace. At least one of the pumps is a liquid ring pump. Oil is utilised to form the liquid ring and the oil is selected to be compatable with or the same as the oil to be removed from the contaminated components.

19 Claims, 2 Drawing Sheets

DE-OILING METHOD

Figure 1:
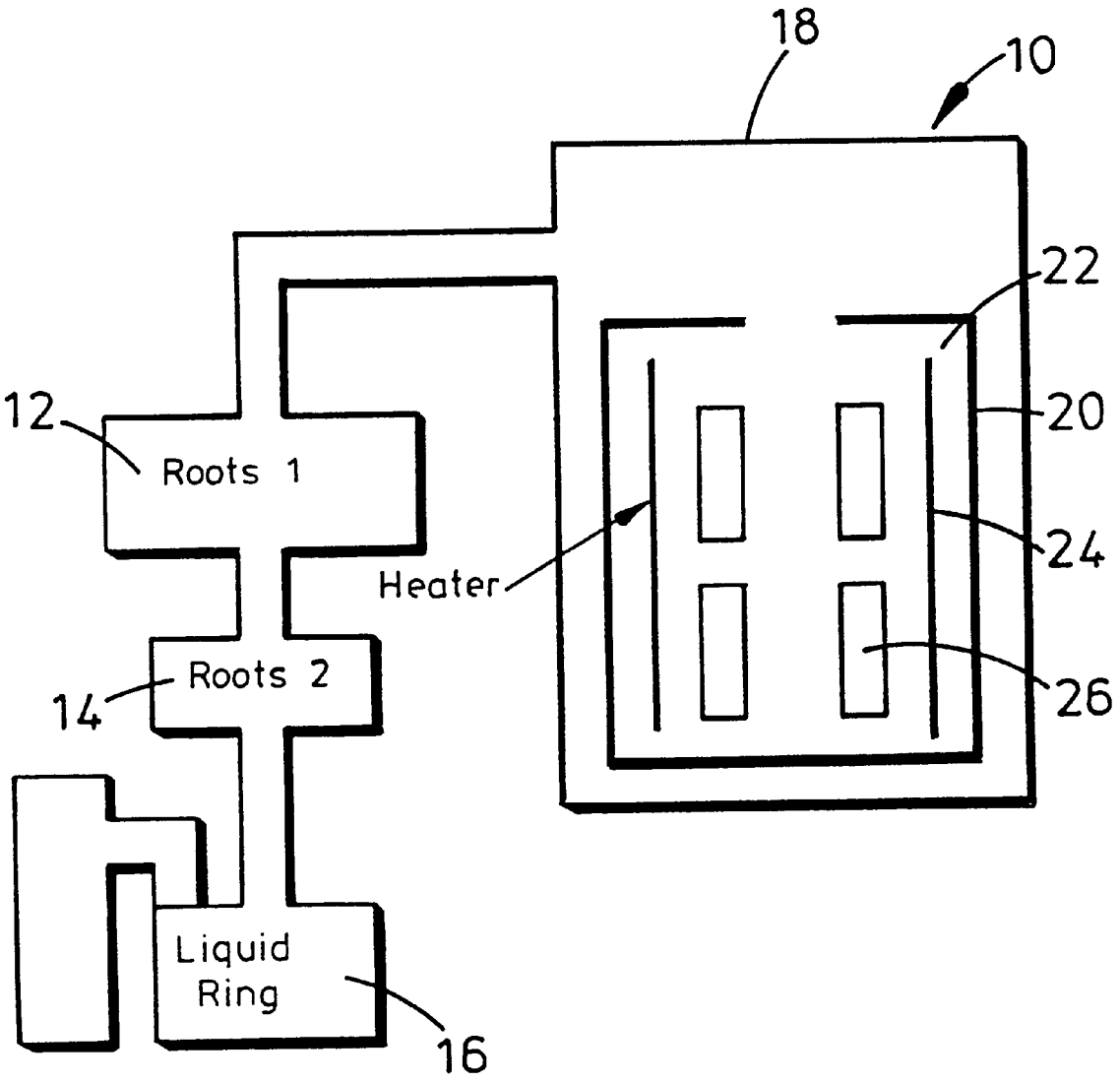

This invention relates to an apparatus and a method for use in de-oiling components.

In industry, assemblies of pressings, such as evaporators, radiators, air-conditioning units and the like are formed of layers of aluminium alloy strips which have been brazed together. During pressing, the strips are often contaminated with the oil used to lubricate the presses and such oil must be removed prior to the brazing operation taking place. In the past, this de-oiling was carried out using solvents however, due to environmental concerns, use of such solvents is now discouraged.

One recently introduced method of de-oiling such components involves heating the contaminated components to temperatures between 250° C. and 350° C. in a vacuum furnace. The vacuum is achieved through use of Roots blowers and rotary piston pumps. However, this arrangement has encountered numerous problems including the relatively low viscosity oil being removed from the components condensing in the piston pump and either causing the pump to seize, due to the thinning of the pump lubricating oil, or the loss of vacuum due to the relatively high vapour pressure of the press lubricating oil. In order to minimise these problems, cryogenic condensers have been provided between the furnace and the piston pump with the intention that the oil vapour will be trapped in the condenser, and thus will not contaminate the pump. In practice, such condensers are only 80% efficient and a considerable quantity of oil still reaches the piston pump.

Further, there are a number of risks associated with the use of such vacuum furnaces. In particular, if any oil droplets remain in the furnace there is a risk that these will ignite, and cause an explosion, when the hot furnace is opened to remove the de-oiled components.

It is among the objects of the embodiments of the present invention to obviate and mitigate these disadvantages.

According to the present invention there is provided apparatus for use in de-oiling components, the apparatus comprising:

a furnace for receiving components to be de-oiled; and means for creating a vacuum in the furnace, said means including a liquid ring pump, wherein oil is utilised to form the liquid ring and the oil is selected to be compatible with or the same as the oil to be removed from the components.

According to a further aspect of the present invention there is provided a method of de-oiling contaminated components, the method comprising the steps:

heating the oil-contaminated components in a furnace;

pulling a vacuum in the furnace using a liquid ring pump utilising oil to form the liquid ring; and selecting the oil utilised to form the liquid ring for compatibility with the oil to be removed from the components.

As used herein, the term "oil" is intended to encompass oils, greases and the like as may be used for lubrication and cooling of machinery, tools and components.

In use, the invention allows the vaporised oil from the components heated in the furnace to condense within the pump, or in the pipework leading to the pump, without adversely affecting the operation of the pump. Any excess oil collecting in the pump is simply drained away for disposal or separation and re-use. Thus, the need to periodically replace "contaminated" pump oil is obviated. Also, apparatus necessary for condensing the vaporised oil before it reaches the pump, such as the cryogenic condensers provided in conventional systems having rotary piston pumps, may be omitted, providing a significant saving in plant costs: a simple heat exchanger\condenser may be provided on the pump exhaust to condense any oil vapour which passes through the pump.

Preferably, the system includes lobed pumps, most preferably one or more Roots blowers. As the operation of these pumps is unaffected by the presence of oil vapour in the air being drawn from the furnace such pumps may be provided between the liquid ring pump and the furnace. Most preferably, these pumps are vertically spaced to minimise collection of condensate therebetween.

Preferably also, the furnace is provided with heating means spaced from the walls of the furnace chamber, to facilitate cooling of the heating means and the components at the end of a de-oiling cycle, before opening the chamber: if the furnace temperature is high on opening the chamber there is a risk of explosion through ignition of any oil remaining in the chamber. It is further preferred that the furnace chamber, and the components therein, are cooled by venting the chamber at the end of the cycle. Preferably, the chamber is vented with an inert gas, such as nitrogen. Most preferably, the heating means and the components are located in a hot zone defined by a heat shield within the chamber, to increase heating efficiency. However, the heat shield should be arranged to allow heating of the chamber walls to a temperature sufficient to avoid oil condensing on the walls.

Preferably also, the piping between the furnace and the pump is inclined, such that any condensate forming in the piping flows away from the furnace. In addition, or alternatively, the piping may be heated to a temperature sufficient to avoid or at least minimise condensation on the piping.

The invention has particular application in de-oiling aluminium alloy strips, as used in the auto industry to form evaporators, radiators, air conditioners and the like, which have been contaminated with lubricating oil from the presses used to form the strips. In this application it has been found that, for safe and efficient operation of the system, it is preferred that: the walls of the furnace chamber are maintained at above 85° C.; the hot zone is defined by a single heat shield; the process pressure is less than $7\times10^{-2}$ mbar; the hot zone temperature is about 350° C.; and the components, or furnace load, should be heated to about 275° C. within fifteen minutes, which typically requires conditioning, or pre-heating, of the furnace.

Figure 2:
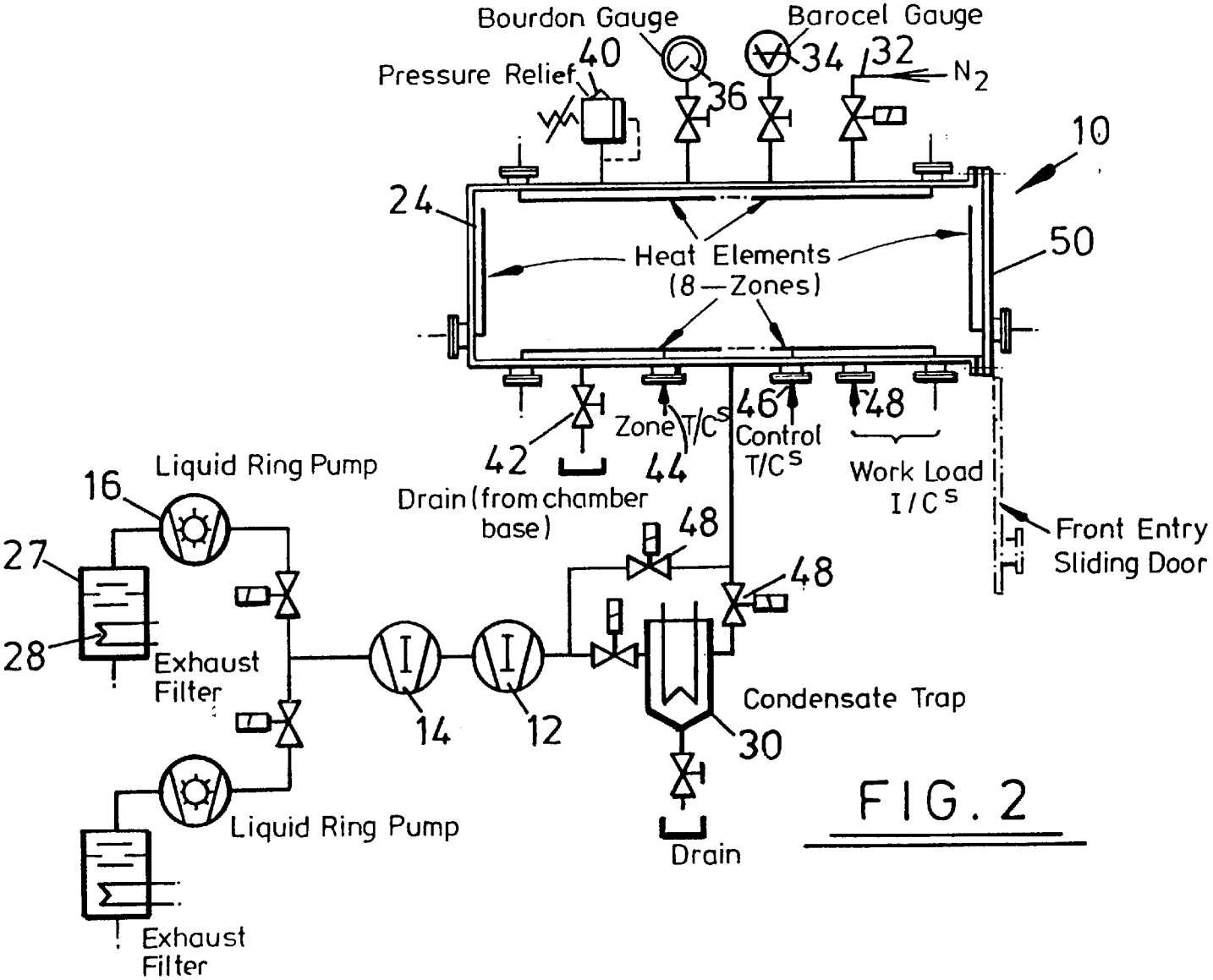

These and other aspects of the present invention will now be described, by way of example, with reference to the accompanying drawings, in which:

FIG. 1 is a diagrammatic representation of apparatus for use in de-oiling components, in accordance with a preferred embodiment of the present invention; and FIG. 2 is a more detailed schematic representation of the apparatus of FIG. 1.

Reference is first made to FIG. 1 of the drawings, which is a diagrammatic representation of apparatus for use in de-oiling components in accordance with a preferred embodiment of the present invention. The apparatus includes a furnace 10 connected to three pumps 12, 14, 16 for pulling a vacuum in the furnace 10. In this particular example the first two pumps 12, 14 are Roots blowers. The first pump 12 has a higher pumping capacity and one of the pumps 12, 14, in this example the intermediate pump 14, is provided with an electronic speed control to allow faster pump down and to permit the speed of the blower to be varied in order to provide optimum matching of the Roots ratios. The third pump 16 is in the form of a two stage liquid ring pump 16. In testing, a pump system comprising a 2,500 $m^3$/hr Roots blower 12, backed by a 1,800 $m^3$/hr Roots blower 14, in turn backed by a liquid ring pump 16 with a displacement of 100 $m^3$/hr was found to be capable of reaching a pressure in the region of $2\times10^{-2}$ mbar.

The furnace 10 comprises a chamber 18 within which a single layer sheet of stainless steel 20 defines a hot zone 22. Within the hot zone 22 are the heaters 24, in this example in the form of sealed Incoloy™ mineral insulated heaters. All of the electrical connections for the heaters 24 are provided outside the vacuum chamber 18 in order to reduce the possibility of oil vapour being ignited by sparks. The components 26 to be de-oiled are of course also located within the hot zone 22.

Reference is now also made to FIG. 2 of the drawings, from which it will be noted that the exhaust from the liquid ring pump 16 is provided with an exhaust filter 27 in the form of a baffled chamber including a heat exchanger\condenser 28. Also shown in FIG. 2 is a cryogenic condenser 30 provided between the first Roots blower 12 and the furnace 10. The condenser 30 removes a large proportion (up to 80%) of vapour from the air drawn from the furnace 10 but, as described below, is not considered an essential feature of the apparatus.

FIG. 2 also illustrates the various sensors, inlets and outlets provided on the furnace 10. In particular, the furnace is provided with: a nitrogen inlet 32; a capacitance manometer 34 for vacuum measurement, a Bourdon gauge 36 for pressure measurement; a pressure relief valve 40; a drain 42 from the furnace chamber base; and temperature sensors for the hot zone 44, the heaters 46 and the components 48 located in the furnace.

In use, oil-contaminated components, in this example aluminium alloy evaporators for use in forming automobile air-conditioning systems, are located into the conditioned, or pre-heated, furnace 10. The pumps 12, 14, 16 are switched on and reduce the furnace pressure to less than $7\times10^{-2}$ mbar. The hot zone 22 in the furnace is then heated to around 350° C., with the components being heated to about 275° C. within around fifteen minutes. Also, the walls of the vacuum chamber 18 are heated to at least 85° C. to ensure that the oil vapour will not condense on the walls.

Due to this pressure and temperature environment any oil contaminating the aluminium components evaporates and is drawn from the furnace 10. Depending on the configuration of the valves 48 around the cryogenic condenser 30, the air drawn from the furnace either bypasses the condenser or passes through the condenser, in which case around 80% of the oil vapour condenses therein any may subsequently be removed. Any oil vapour remaining in the air passes through the Roots blowers 12, 14, without adversely affecting their operation, before passing through the liquid ring pump 16, the majority of the oil vapour remaining in the air condensing in and around the pump 16. The pipework between the pump 16 and the furnace 10 is inclined such that any condensate in the pipework tends to drain towards the pump 16. Also, the piping between the furnace 10 and the pump 16 is heated to minimise the possibility of such condensate forming.

The sealing oil in the pump 16 is selected to be compatible with the oil that has been removed from the components such that mixing of the oils does not adversely affect their operation of the pump 16. In most cases, the oil in the pump will be the same as the oil to be removed from the components, for example Winsor Durel oil. Any excess oil is simply blown through the pump 16, or may be drained from the pump condenser.

At the end of the de-oiling cycle, which is likely to last for about twenty minutes, the chamber 18 is vented with nitrogen through the inlet 34 to cool the heaters 24 and the components. Thus, when the furnace door 50 is opened the lowered temperatures will reduce the likelihood of ignition of any oil remaining in the furnace, which can result in explosion.

It will be clear to those of skill in the art that the above-described system obviates the difficulties encountered with oil contamination in conventional pump systems. Further, it is believed that the disclosed system will operate effectively without requiring provision of the condenser 30, substantially reducing the costs associated with the de-oiling plant. Also, the disclosed furnace configuration has been found to allow the de-oiling process to be carried out satisfactorily with relatively low power heaters and a much reduced risk of explosion.

It will also be clear to those of skill in the art that the above-described embodiment is merely exemplary of the present invention, and that various modifications and improvements may be made thereto without departing from the scope of the invention.

We claim:

1. Apparatus for use in de-oiling components, the apparatus comprising:

a furnace for receiving components to be de-oiled; and means for creating a vacuum in the furnace, said means including a liquid ring pump, wherein oil is utilised to form the liquid ring and the oil is selected to be compatible with or the same as the oil to be removed from the components.

2. The apparatus of claim 1 wherein a condenser is provided on the exhaust of the liquid ring pump, to condense any oil vapour which passes through the pump.

3. The apparatus of claim 1 wherein said means includes also a lobed pump.

4. The apparatus of claim 3 wherein the lobed pump is in the form of a Roots blower.

5. The apparatus of claim 3 wherein a plurality of lobed pumps are provided, and at least one of the pumps is provided with means for varying the speed thereof.

6. The apparatus of claim 3 wherein the lobed pump is provided between the liquid ring pump and the furnace.

7. The apparatus of claim 3 wherein a plurality of lobed pumps are provided and are vertically spaced to minimise collection of condensate therebetween.

8. The apparatus of claim 1 wherein the furnace is provided with heating means for heating the furnace the heating means being spaced from the walls thereof.

9. The apparatus of claim 8 wherein a heat shield defines a hot zone within the furnace for accommodating the heating means and the components to be de-oiled.

10. The apparatus of claim 9 wherein the heat shield is arranged to allow heating of the furnace walls to a temperature sufficient to avoid condensation of oil on the walls.

11. The apparatus of claim 1 wherein piping between the furnace and the liquid ring pump is inclined such that any condensate forming in the piping flows away from the furnace.

12. The apparatus of claim 1 wherein piping between the furnace and the liquid ring pump is provided with heating means for heating the piping to a temperature sufficient to avoid or at least minimise condensation on the piping.

13. A method of de-oiling contaminated components, the method comprising the steps:

heating the oil-contaminated components in a furnace;

pulling a vacuum in the furnace, the vacuum being created using a liquid ring pump utilising oil to form the liquid ring, and the oil utilised to form the liquid ring is selected for compatibility with the oil to be removed from the components.

14. The method of claim 13 wherein the furnace and the components therein are cooled by venting the furnace chamber at the end of a de-oiling cycle.

15. The method of claim 14 wherein the furnace chamber is vented with an inert gas.

16. The method of claim 13 wherein the walls of the furnace are heated to a temperature sufficient to avoid condensation on the walls.

17. Apparatus for de-oiling components, the apparatus comprising:

a furnace for receiving and heating components to be de-oiled;

means for creating a vacuum in the furnace and drawing vaporized oil from the furnace, said means including a liquid ring pump, wherein oil is utilised to form the liquid ring and the oil is selected to be compatible with or the same as the oil to be removed from the components; and a condenser upstream of the liquid ring pump for removing a proportion of the vaporized oil drawn from the furnace.

18. A method of de-oiling contaminated components, the method comprising the steps of:

heating oil-contaminated components in a furnace;

pulling a vacuum in the furnace, to vaporize the oil, using a liquid ring pump utilising oil to form the liquid ring, the liquid ring oil being selected for compatibility with the oil to be removed from the components;

drawing the vaporized oil from the furnace; and condensing a proportion of the vaporized oil in a condenser located upstream of the liquid ring pump.

19. Apparatus for de-oiling components, the apparatus comprising:

a furnace for receiving and heating components to be de-oiled;

means for creating a vacuum of at least $7\times10^{-2}$ mbar in the furnace and drawing vaporized oil from the furnace, said means including a liquid ring pump, wherein oil is utilised to form the liquid ring and the oil is selected to be compatible with or the same as the oil to be removed from the components; and a condenser upstream of the liquid ring pump for removing a proportion of the vaporized oil drawn from the furnace.

* * * * *